US010253537B2

(12) United States Patent
Kreyenborg

(10) Patent No.: US 10,253,537 B2
(45) Date of Patent: Apr. 9, 2019

(54) ROLLER CARRIAGE FOR THE RECEPTION OF A SLIDING DOOR WITH A LIFT-OFF PROTECTION DEVICE

(71) Applicant: DORMA Deutschland GmbH, Ennepetal (DE)

(72) Inventor: Ralf Kreyenborg, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/940,967

(22) Filed: Nov. 13, 2015

(65) Prior Publication Data

US 2016/0138311 A1 May 19, 2016

(30) Foreign Application Priority Data

Nov. 14, 2014 (EP) ..... 14193364

(51) Int. Cl.
*E06B 3/46* (2006.01)
*E05D 15/06* (2006.01)

(52) U.S. Cl.
CPC ..... *E05D 15/063* (2013.01); *E06B 3/4636* (2013.01); *E05Y 2201/614* (2013.01); *E05Y 2900/10* (2013.01); *E05Y 2900/132* (2013.01)

(58) Field of Classification Search
CPC . E05D 15/063; E06B 3/4636; E05Y 2900/10; E05Y 2201/614
See application file for complete search history.

(56) References Cited

U.S. PATENT DOCUMENTS 2,940,113 A * 6/1960 Riser ..... E05D 15/063 16/105
3,425,162 A * 2/1969 Halpern ..... E05D 15/0634 16/105
5,598,666 A * 2/1997 Kurth ..... A47K 3/34 4/557
5,678,280 A * 10/1997 Haab ..... E05D 15/0656 16/87.6 R
7,065,831 B2 * 6/2006 Elmer ..... E05D 15/0652 16/106

(Continued)

FOREIGN PATENT DOCUMENTS

EP 2801685 A2 * 11/2014 ..... E05D 15/063
WO WO 2011029770 A1 * 3/2011 ..... E05D 15/063

OTHER PUBLICATIONS

Machine translation of EP 2801685 (Lohr), retrieved Aug. 4, 2017 from https://worldwide.espacenet.com/publicationDetails/biblio?CC=EP&NR=2801685A2&KC=A2&FT=D&ND=3&date=20141112&DB=&locale=en_EP.*

*Primary Examiner* — Jerry E Redman
*Assistant Examiner* — Abe Massad
(74) *Attorney, Agent, or Firm* — Cantor Colburn LLP

(57) ABSTRACT

A roller carriage for the reception of a sliding door includes a roller module for a displaceable affixing at a roller running path and a basic body for the attachment to the sliding door. The roller carriage includes a lift-off protection device for the protection against removal of the roller module out of the displaceable affixing at the roller running path. The lift-off protection device includes a lift-off protection element which is supported to be movable between a protection position and a release position, as well as an arresting device for an arresting of the lift-off protection element at least in the protection position.

12 Claims, 7 Drawing Sheets

(56) References Cited

U.S. PATENT DOCUMENTS

| | | | | |
|---|---|---|---|---|
| 9,085,924 | B2 * | 7/2015 | Tidwell | E05D 15/0669 |
| 2009/0229184 | A1 * | 9/2009 | Hideki | B66B 13/08 49/70 |

* cited by examiner

ROLLER CARRIAGE FOR THE RECEPTION OF A SLIDING DOOR WITH A LIFT-OFF PROTECTION DEVICE

FIELD

The present disclosure relates to a roller carriage for the reception of a sliding door with a lift-off protection device, to a sliding door installation including at least one such roller carriage, as well as to a method for protecting a sliding door against lifting-off.

BACKGROUND

Conventional sliding doors need to be brought into a displaceable bearing, in order to be movable between an opened and a closed condition. For this purpose, the sliding doors, which may likewise be referred to as sliding door leaves, are equipped with a roller carriage to which the sliding door is attached. Obviously, two or more roller carriages can be attached to one sliding door. As known, such a roller carriage is placed upon, respectively placed into a roller running path, in order to guarantee the displaceable bearing of the roller carriage and therefore likewise of the sliding door. Furthermore, it is known to provide a protection against unwanted removal of the roller carriage from the roller running path. This protection is in particular necessary, if for example the sliding door travels at a high speed into a terminal position and is abruptly decelerated in said position. Said abrupt deceleration may result in, at least partially, a reorientation of the kinetic energy, and lead to the roller carriage jumping in the roller running path. This behavior may be so strong, that the roller carriage jumps out of the roller running path, and would result in the sliding door falling down. Likewise, the sliding door should be basically protected against unwanted lifting.

This arrangement in particular with regard to unwanted ingress, respectively to a burglary protection is an important functionality.

The lift-off protection devices provided in the sliding door installations of the state-of-the-art are of a very simple kind. Thus, for example flat washers are utilized, which by means of a rotation can be brought into a protecting position. In this position, the flat washers basically prevent a lifting-off, however, there is still the risk that such an eccentric flat washer is displaced during normal operation, in particular when they are used over long periods of time, and that therefore the protection function is suspended. Even at high mechanical loads of the roller carriage, in particular in the event of hard impacts in a terminal position, this may result in an unwanted alteration of the protection function, such that, despite the presence of such a lift-off protection device, lifting of the sliding door may result in endangering the person using the door.

The present disclosure overcomes the above-described disadvantages and provides a roller carriage to simplify mounting and to increase the operational safety of a sliding door installation as well as of a corresponding roller carriage in a cost-effective and simple manner.

SUMMARY

Features and details, described in conjunction with the inventive roller carriage are obviously also valid in conjunction with the inventive sliding door installation as well as with the inventive method, and respectively vice versa, such that mutual reference is made, respectively can be made with respect to the disclosure of individual aspects of the invention.

According to the disclosure, a roller carriage is provided for the reception of a sliding door. Said roller carriage includes a roller module for a displaceable affixing to a roller running path. Furthermore, a basic body is provided for the attachment to the sliding door. In this case, the roller carriage includes a lift-off protection device as a protection against removal of the roller module from the displaceable affixing at the roller running path. The inventive roller carriage is distinguished in that the lift-off protection device includes a lift-off protection means, which is supported to be movable between a protection position and a release position, as well as an arresting device for arresting the lift-off protection means in the protection position.

An inventive roller carriage includes in particular at least two structural components namely the roller module and the basic body. In this case, obviously further structural components may be provided and/or said two structural components may be composed of individual bodies. A roller carriage according to the conception of the present disclosure is an overall system, which fulfills at least two functions. On the one hand, the roller module allows for the displaceable affixing on the roller running path. Even if, already in this stage, the terminology of roller is utilized here, an affixing of bearing devices for rollers represents only one optional embodiment of an inventive roller carriage. Obviously for the displaceable bearing, such a roller carriage may likewise include a linear guidance, for example an anti-friction bearing or a linear drive. However, with regard to reduced complexity and lower cost, the embodiment with rotatable rollers is preferred for such a bearing device. The second function provided consists in the attachment of the sliding door. In this case, the attachment may be a clamped attachment.

According to the disclosure, the roller module and the basic body are separate structural components respectively separate bodies. Each one of said two structural components, namely the roller module and/or the basic body, may in turn include a plurality of individual components, which are connected among each other. Thus, the roller module may include for example corresponding bearing devices in the shape of rotatably supported rollers. The basic body may include a plurality of individual structural components, such as for example further devices for additional functions. In addition to a height adjustment, they may as well consist of a securing device, a fixing device or else a clamping device, by means of which the sliding door can be attached to the basic body.

Basically and according to the disclosure, the direction of movement by means of the roller carriage is freely selectable. Thus, in this case within the scope of the present disclosure, a movement along a straight can be performed just as well as a movement along a line of movement, which is curved or curved several times, is conceivable.

In this case, a displaceable affixing to a roller running path is to be understood specifically for the respective embodiment of the bearing. In case bearing devices in the shape of individual rollers are provided, said rollers are inserted into a corresponding roller running path. If for example an anti-friction bearing is provided, affixing the roller module is realized on a corresponding sliding rail, respectively at a corresponding sliding rail.

Preferably, the roller module is manufactured from steel casting material. The basic body may be lighter and manufactured for example from light metal diecast. As light metal diecast, in particular aluminum or zinc are utilized.

According to the disclosure, the roller carriage is now equipped with a lift-off protection device. Said device serves the function of preventing deliberate or undeliberate removal of the roller module. In case, both active unhooking of the roller carriage as well as the result of jumping caused by mechanical interference or high speed when displacing the sliding door should be prevented. In both cases, the lift-off protection device is intended to retain the roller module and in particular a bearing device of the roller module in the desired hooked-in contact and thereby in engagement with the displaceable affixing of the roller running path.

In order to be able to guarantee the above-described function, the inventive lift-off protection device is configured to support a lift-off protection means movable between a protection position and a release position. In this case, it is in particular question of a geometrical correlation of the lift-off protection means with the roller running path or further structural components of a housing, in which the roller running path is disposed. Thus, a movement of the lift-off protection device into a protection position may result in a geometrical correlation of the lift-off protection means with a surrounding structural component. Said correlation is based on a reduction of the freedom of movement of the entire roller carriage in or essentially in the direction of gravity. In other words, reducing said freedom of movement reduces the maximum lifting height, which is geometrically tolerated, if at all, by means of said remaining room for movement. The reduction is limited to a remaining room for movement, which is smaller or equal, in particular however, completely smaller than the maximum lifting freedom from the roller running path so that the roller module remains on the roller running path. In case for example the roller running path is equipped with a convex running surface and a corresponding roller is equipped with a bearing device having a concave circumference, the depth of said concave circumference is the maximum admissible lifting height from the roller running path. According to the disclosure, it is now ensured that the maximum remaining movement possibility above the protection position of the lift-off protection means is smaller than said maximum admissible lifting height between the roller running path and the associated bearing device.

In the release position, a considerably larger freedom of movement is intended such that both, hanging the roller carriage into the roller running path and the deliberate active removal of the roller module, respectively of the roller carriage from the roller running path can be realized in a simple and most of all quick manner.

In addition to differentiating the two distinct positions, according to the disclosure, an arresting device is provided, which is configured to be in particular separate from the lift-off protection device, respectively separate from the lift-off protection means. Said arresting device allows for arresting the lift-off protection means, at least in the protection position. Obviously, an arresting can be likewise realized in further positions, in particular in the release position as will be explained in detail later. Providing such an arresting option allows now for performing a two-staged mounting. As soon as the roller carriage is placed upon, respectively into the roller running path, subsequently the lift-off protection means is moved from the release position into the protection position. While in the known state-of-the-art the mounting process finished here, according to the disclosure, in an additional step the arresting device is activated, and arresting the lift-off protection means in the protection position is realized. This circumstance leads to the fact that the arresting prevents a movement of the lift-off protection means out of the protection position, even if high mechanical interferences have the tendency to move the lift-off protection means out of the protection position. Said additional protection serves to even increase the application safety and in particular to prevent, at an almost 100% probability, the unwanted removal of the roller carriage out of the roller running path. This arrangement represents an important advantage, in particular in correlation with appropriate dampening elements in the terminal abutments for the roller carriage, which may result in corresponding forces acting upon the roller carriage.

Basically, in this case, the type of arresting is irrelevant. This means both, a form closure, a frictional connection or a non-positive connection may provide a corresponding arresting option. Obviously, combinations of different arresting functions following the idea of the present disclosure are conceivable. A form closure configuration of the arresting device is particularly simple and most of all cost-effective to produce, at least partially. This device results in being able to provide the arresting function by means of simple geometrical correlation of arresting means yet to be described.

In this case, the lift-off protection device may have additional functionality, in particular in the shape of provided elasticity. For example the lift-off protection means may at least partially have a spring elastic configuration. In the event of a movement in the direction of gravity, this circumstance results for the roller carriage in that a contact with the lift-off protection means with the corresponding securing housing wall of a roller running path does not lead to a mechanical interference with the lift-off protection means. Such a jumping in the direction of gravity is rather dampened by such spring elasticity. Preferably, the arresting means is accordingly at least partially manufactured from spring elastic plastic material. Obviously, other components of the lift-off protection device or even a partial portion of the lift-off protection means may be manufactured from a different material, in particular from metal.

Moreover, the roller module is attached to the basic body in order to provide for a sufficient protecting function. Said attachment is in particular provided with a displaceable and fixable bearing such as to allow for a basic height adjustment between the roller module and the basic body in relation to each other. Thereby, an overall roller carriage system has been created for which the overall function of the lift-off protection device is effective.

The inventive roller carriage has a further advantage in that the arresting device is configured for an arresting in the release position. Thus, an additional arresting position is provided. Being able to arrest the release position will be particularly helpful during mounting. When inserting for example the roller carriage while the sliding door is already mounted, the arresting device will be arrested in its release position. During the entire time of placing the roller carriage onto a roller running path, in particular based on the high possible weight of the sliding door, important forces may act upon the roller carriage. Such action of forces may result in that the lift-off protection device moves at this point in time into the, still unwanted, protection position. However, in the protection position, the lift-off protection device would complicate, respectively completely prevent the insertion process. Arresting the lift-off protection device in the release position prevents said unwanted action such that mounting, even in difficult situations and moreover when important weights are involved, becomes simple, cost-effective and quick. Moreover, such an arresting possibility facilitates the basic finding of the release position for said mounting process. The arresting device is in particular limited exclusively to said defined two arresting positions such that all other positions are preferably instable positions, which automatically, for example by means of spring force or inclined planes, are transferred into the arrested protection position or the arrested release position.

The overall safety of an inventive roller carriage is thereby further improved, both during the mounting process and during operation.

It is likewise advantageous, if, in an inventive roller carriage, the arresting device includes at least one arresting means intended for an engagement. at least sectionwise, in an arresting reception, which correlates with the protection position of the lift-off protection means. The arresting means is in particular configured for a positive engagement, at least sectionwise, in another arresting reception, which correlates with the release position of the lift-off protection means. A correlation between an arresting pin, as an arresting means, and a corresponding arresting groove, as an arresting reception, may be provided. Such a pin, respectively cam thus latches in the arresting reception.

Obviously, an arresting may be likewise achieved by means of a kinetic reversal. Also, more complex geometrical forms are conceivable within the scope of the present disclosure for the configuration of the arresting means, respectively of the arresting receptions. An at least partial positive reception results in that in particular blocking, respectively arresting is based on a surface contact. Thereby, basically the arresting reception may be larger than the associated arresting means, however, at least a part of the surface of the arresting reception reaches full contact with a part of the surface of the arresting means and forms, in this way, the desired partial form closure. Preferably, such an enlargement is even intended such that the arresting and thereby the protection position, respectively the release position can be found more easily. Therefore, it is preferred if the arresting reception is configured to be larger in a range of approximately 5% and approximately 10% than the corresponding external contour of the arresting means. Obviously, guiding means acting in the direction of an arresting movement may be provided, which for example may guarantee a corresponding guidance of the arresting means into its arresting position, for example in the shape of conical or sloped surfaces.

A further advantage is, if, in an inventive roller carriage, the lift-off protection means is supported to be movable between the protection position and the release position about an axis of movement. In this case, the lift-off protection means includes a lift-off protection portion with an eccentric external contour, at least in sections. In this case, said external contour is configured to be eccentric in relation to the axis of rotation and thereby to the axis of movement of the lift-off protection means. In correlation with a corresponding roller running path, this configuration results in that the overall extension of the lift-off protection device can be modified by means of a rotation of the lift-off protection portion. In the protection position, said extension is larger in the direction of gravity than in the release position. This circumstance results in the possibility already described in the introduction, to modify the correlation and thereby the clearance between the lift-off protection means, in particular the lift-off protection portion, and the opposite part of a housing wall or the roller running path, and to fulfill thereby the protection function. It is preferred, if the movement of the lift-off protection means about the axis of movement is configured to be less than approximately 90° and, accordingly at least one terminal abutment is provided for limiting said movement. In this way a single movement of the hand will realize a transposition between the protection position and the release position. In particular following the mounting of the roller carriage during the insertion into the roller running path, a quick lift-off protection may result in limiting the risk to a minimum that the entire sliding door experiences unwanted falling down.

Moreover, it is advantageous, if, in an inventive roller carriage, the roller module presents a support portion, which extends in sections circumferentially along the lift-off portion with regard to a direction of gravity below the lift-off protection portion. Such a support portion is preferably disposed with a defined movement gap towards the lift-off protection portion. Said support portion is configured to be small and ranges for example from less than approximately 2 mm, in particular ±1 mm. In the event of deformation of the lift-off protection means, in particular in case of bending the lift-off protection portion in the direction of gravity downwards, said support portion serves to contact the latter. The contacting allows now for providing an additional support possibility by opening up an additional path of force via said support portion. It is now possible to absorb in addition at least a part of the force and thereby to prevent an additional support, a mechanical interference or damage of the lift-off protection means. Said supporting function reduces the necessary mechanical load capacity of the lift-off protection portion as well as of the lift-off protection means such as to be able to configure them to be simpler, lighter and more cost-efficient. In the event the roller carriage jumps off the roller running path after a hard impact in a terminal position, bending of the lift-off protection portion by means of said support at the support portion is now able to relieve itself mechanically in a sufficient manner.

It is likewise advantageous, if, in an inventive roller carriage, the lift-off protection portion includes a convex surface portion. In this case, in particular a radius in the range between approximately 5 mm and approximately 20 mm is installed. In this case, in particular a cylinder envelope surface portion or a conical surface portion may be provided, in order to be able to compensate for corresponding manufacturing tolerances by means of the convex configuration. This circumstance translates into less complexity for the manufacturing expense and in particular when mounting the roller carriage, and into higher functional safety for the lift-off protection device.

Moreover, it is advantageous, if in an inventive roller carriage the lift-off protection device includes at least one first spring element, which charges the lift-off protection means in the direction of the protection position with a spring force. In this case, it may be for example a rotational spring or an axially acting spring. Also according to the idea of the present disclosure, combined acting springs can be employed as the first spring element. In the event the lift-off protection device can be moved for example rotationally, a rotational spring, as the first spring element, may provide pretension, which, when relieved, automatically moves the lift-off protection device into the protection position. This arrangement increases the safety even further, because after removal of a corresponding counter-force, for example by removing an installation tool from an associated manipulation interface, the lift-off protection means automatically occupies the protection position. Such a rotary spring may be made from steel or else from an elastomer material. Said embodiment will be in particular combined with a second spring element according to the following paragraph.

Thus it may be a further advantage, if, in an inventive roller carriage, the arresting device includes at least one second spring element, which charges an arresting means in the direction of the arresting position with a spring force. Such an arresting means can thus be supported to be movable between an arresting position and a non-arresting position. Said movement is advantageously performed together with the lift-off protection means. A firm connection between the arresting means and the lift-off protection means allows for example the following procedure. Firstly, an axial, in particular linear movement of the lift-off protection means is performed. Due to the firm connection, said movement entrains the arresting means into its non-arresting position. Subsequently, a rotational movement into the protection position is performed, followed by a linear countermovement. Due to the rotational movement, the lift-off protection means is now located in the protection position and, due to the axial, respectively the linear return movement, the arresting means is located in the arresting position for the protection position. The above-described movements are each performed against, respectively with the corresponding spring force. Based on the pretension in the direction of the arresting position, it is ensured that by removing a corresponding mounting force, namely for example removing a mounting tool, the arresting is automatically effective.

It is furthermore advantageous, if, in an inventive roller carriage, the lift-off protection means of the lift-off protection device includes a manipulation interface for applying a mounting force for performing a mounting movement of the lift-off protection means. Such a manipulation interface may include for example a knurling, so as to be able to perform the mounting movement with the fingers. A corresponding manipulation interface in correlation with a mounting tool is conceivable according to the idea of the present disclosure.

It is advantageous, if, in an inventive roller carriage according to the previous paragraph, the manipulation interface is disposed on a first side of the roller carriage, and a bearing support of the roller module for the displaceable affixing at the roller running path is disposed on a second side of the roller carriage, which side is opposite the first side. This arrangement facilitates the accessibility, because in this way, an adjustment of the lift-off protection device can be realized from the front. In this case, the manipulation interfaces, serving likewise for other mounting devices for other functions, may be oriented in the same way, such that the advantages for adjustability are achieved for all mounting devices at the same time. This circumstance translates into a considerably reduced complexity of the entire mounting expense and therefore into reduced mounting time.

A further object of the present disclosure is a sliding door installation, including a roller running path and at least one inventive roller carriage, which is supported to be displaceable in the roller running path. Preferably, at least one sliding door is supported in such a roller running path by means of at least two roller carriages. By employing an inventive roller carriage, an inventive sliding door installation offers the same advantages as those explained in detail in relation to an inventive roller carriage.

Another object of the present disclosure is a method for protecting a sliding door of a sliding door installation according to the present disclosure, including the following steps:

displaceable affixing of a roller carriage according to the present disclosure on the roller running path, moving the lift-off protection means of the lift-off protection device out of a release position into a protection position, arresting the lift-off protection means in the protection position by means of an arresting device.

By employing an inventive roller carriage, an inventive method offers the same advantages as those explained in detail in relation to an inventive roller carriage.

BRIEF DESCRIPTION OF THE DRAWINGS

Further advantages, features and details of the disclosure will result from the following description, in which exemplary embodiments of the disclosure are described in detail, reference being made to the drawings. In the drawings.

DETAILED DESCRIPTION OF THE DRAWINGS

Figure 1:
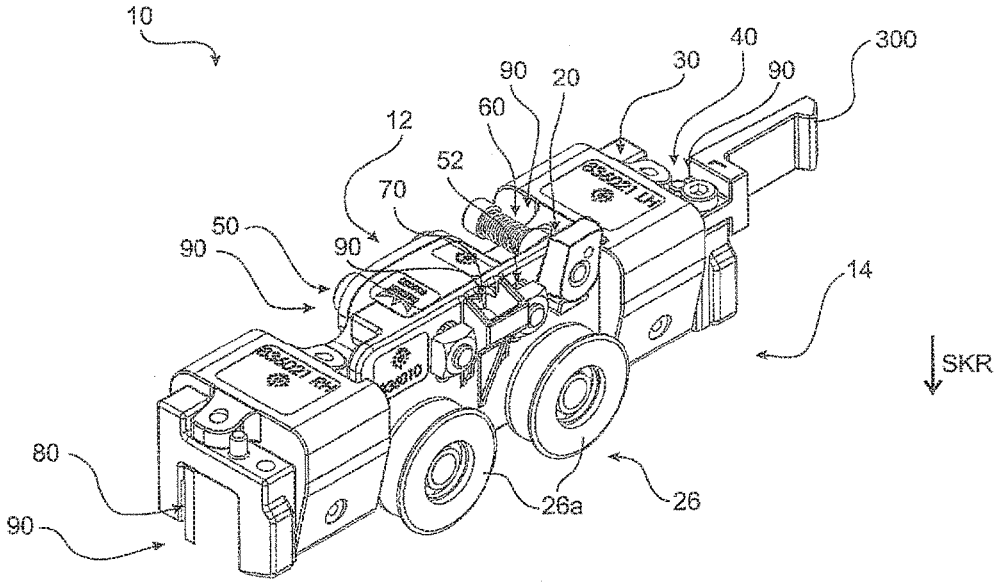
FIG. 1 an embodiment of a roller carriage.

An embodiment of a roller carriage 10 is illustrated in an isometric illustration in FIG. 1. Basically, said carriage includes two structural components. The components are, on the one hand, the roller module 20 and, on the other hand, the basic body 30. In this case, both structural components, namely the roller module 20 and the basic body 30 include a plurality of different individual parts. Said individual parts will be briefly explained in the following.

Figure 3:
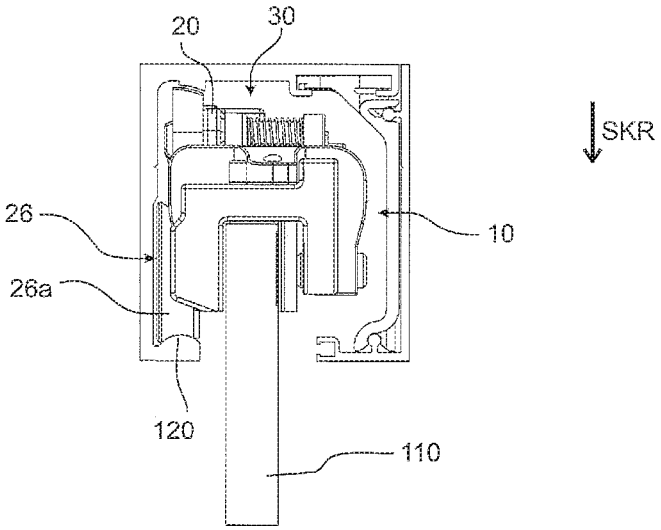
FIG. 3 a lateral illustration of a roller carriage in a roller running path, FIG. 4 a lateral illustration of a roller carriage in cross-section, FIG. 5 the illustration of FIG. 4 in an isometric view, FIG. 6 a lateral illustration of a roller carriage with a lift-off protection device, FIG. 7 the lift-off protection device in the protection position, FIG. 8 the embodiment of FIG. 7 in the release position, FIG. 9 an embodiment of a lift-off protection device in the protection position, FIG. 10 the embodiment of FIG. 9 during the transpositioning, and FIG. 11 the embodiment of FIG. 9 and FIG. 10 in the release position.
Figure 4:
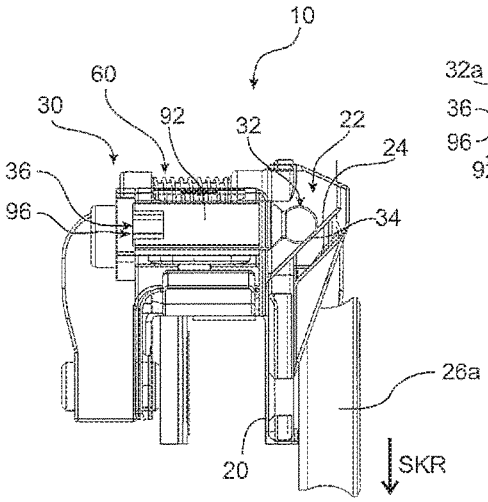
Figure 5:
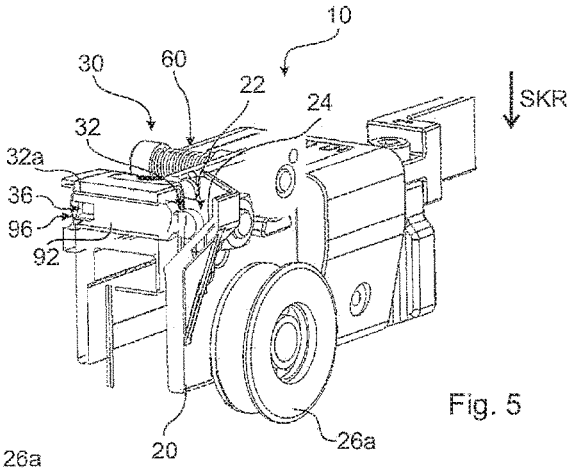

Here, the roller module 20 is equipped with a bearing device 26. Said bearing device 26 is equipped in this case with two rollers 26*a*, which are supported to be rotatable at a basic body of the roller module 20. Said rollers 26*a* can be placed onto, respectively inserted into a roller running path 120, as can be clearly seen in FIG. 2 and FIG. 3. A part of a height adjusting device 70 is provided furthermore at the roller module 20. The detailed components of said height adjusting device 70 are in particular illustrated in the FIGS. 4 and 5. Thus, a first adjusting means 32 is provided, which by means of a manipulation interface 36 is able to perform an adjusting movement. As in this case the first adjusting means 32 is configured as a threaded bolt in an adjusting thread 32, a rotational movement is performed at the manipulation interface 36, which movement simultaneously produces a linear translational movement of the first adjusting means 32. Via a corresponding contacting portion 34, the first adjusting means 32 is in operative connection with a counter-contacting portion 24 of the second adjusting means 22 of the roller module 20. In this case, the explicit action of said adjusting device consists in converting the adjusting movement into a fine-tuning movement along the direction of gravity SKR.

As can be seen in FIG. 1, the roller carriage 10 is equipped with a plurality of different mounting devices 90, which are able to provide different mounting functions. In this case, the already described fine-tuning function of the height of the sliding door 110 is provided by means of the mounting device 90 in the shape of a height adjusting device 70. Furthermore, a mounting device 90 in the shape of a securing device 50 is provided, which after completed fine-tuning of the height of the sliding door 110 provides a clamped fixing between the basic body 30 and the roller module 20.

In this case, a further mounting device 90 consists in an accessory device 40, which is provided by means of a corresponding interface, and an affixed accessory module 300. Moreover, a lift-off protection device 60 is provided as a mounting device 90, which provides a lift-off protection against unwanted removal of the roller carriage 10 out of the position in which it is inserted into the roller running path 120. Furthermore, an attachment device 80 is provided as a glass clamp for a mounting device 90, in order to affix the sliding door 110 in a clamped manner.

All mounting devices have in common that they include at least one mounting means 92, in order to be able to perform a corresponding mounting movement. Moreover, a manipulation interface is provided, intended to allow for performing exactly said mounting movement with the mounting means.

As furthermore revealed in FIG. 1, the roller carriage 10 has different sides, namely the first side 12 and the second side 14. In this case with regard to their manipulation interface 96, all mounting devices are preferably oriented from the same side, namely the first side 12 opposite to the second side 14, on which the bearing device 26 is disposed. This arrangement offers a considerably simpler access.

Figure 2:
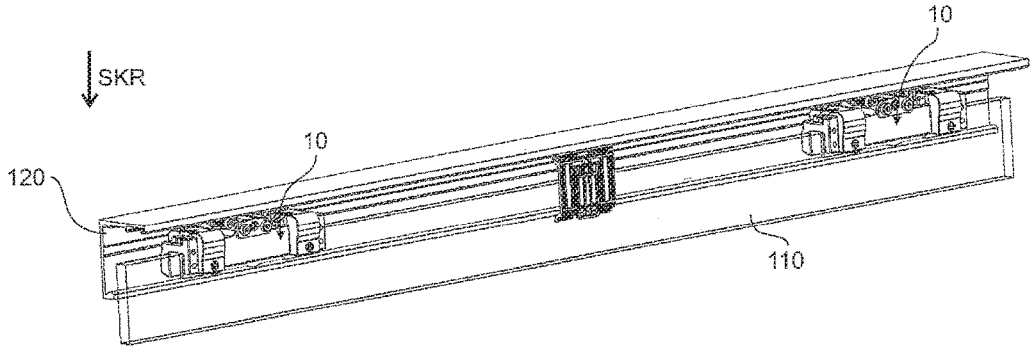
FIG. 2 an embodiment of a sliding door installation.

FIG. 2 reveals how a sliding door 110 is retained by means of two roller carriages 10 according to FIG. 1, and that said two roller carriages 10 are already inserted into the roller running path 120. In a lateral illustration according to FIG. 3, in particular the correlation of the rollers 26*a* with the roller running path 120 is well visible.

Figure 6:
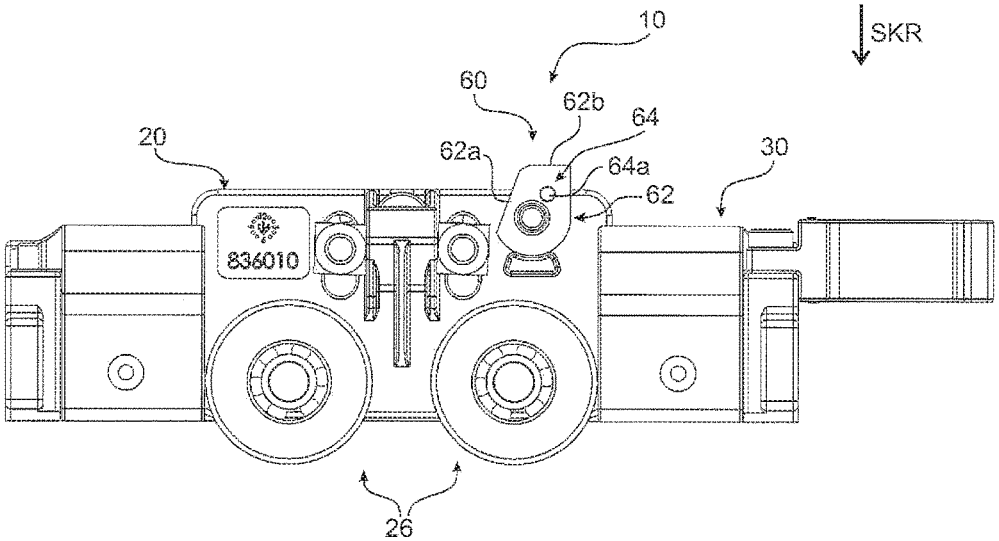

In a lateral illustration, FIG. 6 shows the roller module 20 and here explicitly the lift-off protection device 60. Said lift-off protection device 60 is equipped with a lift-off protection means 62, which is supported to be rotatable in the roller module 20. The illustration according to FIG. 6 shows the lift-off protection means 62 and in particular the lift-off protection portion 62*a* in its protection position SP. At the same time, the arresting device 64 is seen as a pin-shaped extension, wherein just the arresting means 64*a* is visible from the back side. At the same time, in the area of the lift-off protection portion 62*a*, a surface portion 62*b* is visible, which includes a convex surface curvature, not visible here, in order to be able to compensate for corresponding manufacturing tolerances. In particular FIGS. 7 and 8 reveal details in this regard.

Figure 7:
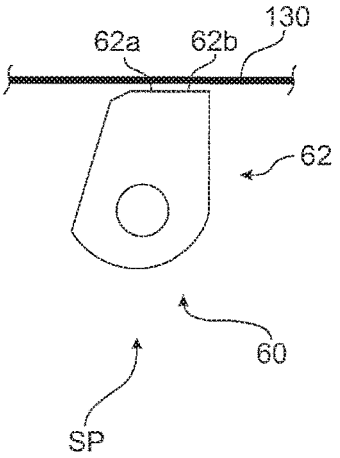
Figure 8:
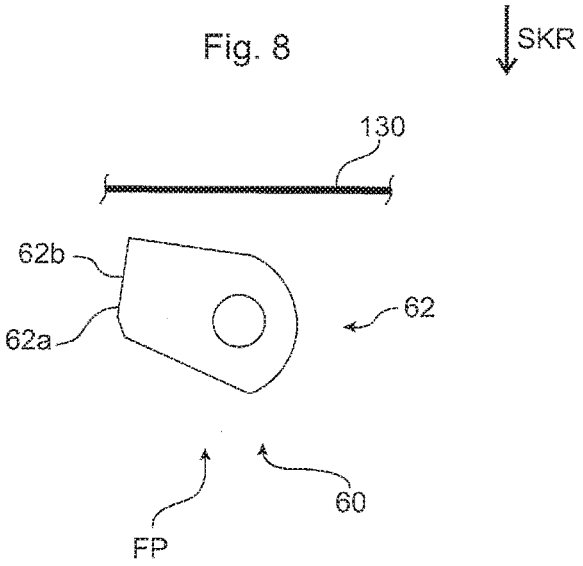

Thus, FIGS. 7 and 8 show the two distinct positions, namely the protection position SP in FIG. 7, and the release position FP in FIG. 8.

The lift-off protection means 62 is rotatable between said two positions. In the protection position SP, it can be seen, that a small gap exists between the surface portion 62*b* of the lift-off protection portion 62*a* and a corresponding housing walling, in this case the running rail 130. Said gap is so small that a lifting as far as to contacting the running rail 130 will not result in a removal out of the roller running path 120. The possible movement in the direction of gravity SKR upwards is in particular revealed in FIG. 3. The concave configuration of the rollers 26 allows for a lifting in the opposite direction to the direction of gravity SKR, and the retaining function is maintained due to the convex configuration of the roller running path 120. The gap, which is visible in FIG. 7, is likewise visible at the top of FIG. 3 with regard to the roller module 20. FIG. 8 illustrates now how, by means of a rotation of the lift-off protection means 62 about less than 90°, the described gap will be considerably increased, such that the surface portion 62*b* of the lift-off protection portion 64 is disengaged and inserting or removing the roller carriage 10 out of the roller running path 120 is possible.

Figure 9:
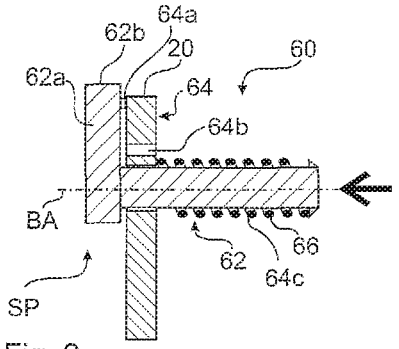
Figure 10:
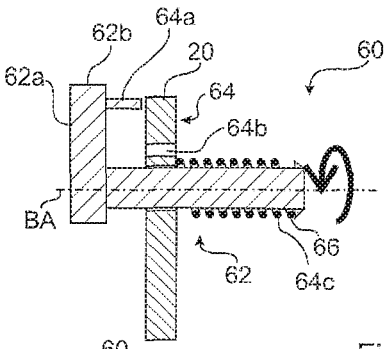
Figure 11:
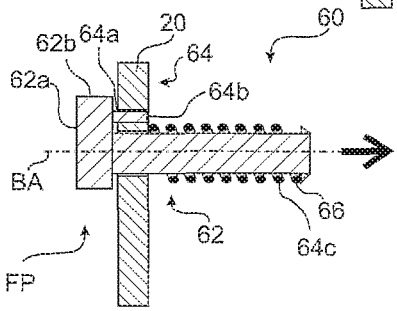
Figure 11:
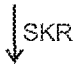

FIGS. 9-11 show details with regard to the transposition in an embodiment with spring elements. In this case, a first spring element 66 as well as a second spring element 64*c* are provided, which are both together configured in their function as rotatably and axially acting screw springs. Said two spring elements 64*c* and 66 act in the following way. In FIG. 9 the lift-off protection device 60 is located in the active position, namely the lift-off protection means 62 is in the protection position SP. For providing a movement, a linear, respectively an axial movement along the axis of movement BA is now realized, in order to bring the arresting means 64*a* out of engagement from a corresponding arresting reception 64*b*. The end of said movement is shown in FIG. 10, in which the entire lift-off protection portion 62*a* is displaced to the left against the force of the spring, and the arresting means 64*a* is thereby exposed. A rotation about the axis of movement BA is now possible, until the lift-off protection portion 62*a* reaches the release position FP according to FIG. 11. If the associated force is now withdrawn, the entire lift-off protection means 62 moves again back, axially and linearly to the right along the axis of movement BA and the arresting means 64*a* engages in the arresting reception 64*b*, in order to guarantee the arresting function. Obviously, said procedure can be reversed in order to switch from the release position FP into the protection position SP.

The above explanation of the embodiments describes the present disclosure based on examples. Individual features of the embodiments, as long as technically reasonable, can be combined independently of each other without leaving the scope of the present disclosure.

The invention claimed is:

1. A roller carriage for the reception of a sliding door, including a roller module configured for displaceably coupling the roller carriage to a roller running path, and a body configured for attaching the roller carriage to the sliding door, the roller carriage comprising a lift-off protection device for the protection against removal of the roller module out of the displaceable affixing at the roller running path, wherein the lift-off protection device includes a lift-off protection component having a shaft defining a longitudinal axis and at least one first spring element, where the lift-off protection component is supported to be movable between a protection position and a release position, wherein an arresting device is configured for arresting the lift-off protection component at least in the protection position and includes at least one second spring element, wherein the at least one first spring element charges the lift-off protection component with a spring force in the direction of the protection position, and the at least one second spring element charges the lift-off protection component with a spring force in the direction of the release position, wherein the charging of the first spring element moves the lift-off protection component in a rotational direction about the longitudinal axis of the shaft and the charging of the second spring element moves the lift-off protection component in an axial direction defined along the longitudinal axis of the shaft.

2. The roller carriage according to claim 1, wherein the arresting device is configured for arresting the lift-off protection component in the release position.

3. The roller carriage according to claim 1, wherein the arresting device includes an arresting component configured for a first positive engagement in a first arresting reception, which correlates with the protection position of the lift-off protection component, and configured for a second positive engagement in a second arresting reception, which correlates with the release position of the lift-off protection component.

4. The roller carriage according to claim 1, wherein the lift-off protection component is supported to be rotatable about the longitudinal axis of the shaft between the protection position and the release position, wherein the lift-off protection component includes a lift-off protection portion having an eccentric external contour.

5. The roller carriage according to claim 4, wherein the roller module includes a support portion, which extends circumferentially along the lift-off protection portion in relation to a direction of gravity below the lift-off protection portion.

6. The roller carriage according to claim 4, wherein the lift-off protection portion includes a convex surface portion.

7. The roller carriage according to claim 1, wherein the lift-off protection component of the lift-off protection device includes a manipulation interface for the application of a mounting force for performing a mounting movement of the lift-off protection component.

8. The roller carriage according to claim 7, wherein the manipulation interface is disposed on a first side of the roller carriage, and a bearing device of the roller module for the displaceable affixing at the roller running path is disposed on a second side of the roller carriage, which side is opposite to the first side.

9. The roller carriage according to claim 1, wherein the lift-off protection device is configured from plastic material.

10. A sliding door installation, including a roller running path and at least one roller carriage for the reception of at least one sliding door and being supported to be displaceable in the roller running path, the at least one roller carriage comprising a lift-off protection device for the protection against removal of a roller module out of the displaceable affixing at the roller running path, wherein the lift-off protection device includes a lift-off protection component having a shaft defining a longitudinal axis and at least one first spring element, where the lift-off protection component is supported to be movable between a protection position and a release position, wherein an arresting device is configured for arresting the lift-off protection component at least in the protection position and includes at least one second spring element, wherein the at least one first spring element charges the lift-off protection component with a spring force in the direction of the protection position, and the at least one second spring element charges the lift-off protection component with a spring force in the direction of the release position, wherein the charging of the first spring element moves the lift-off protection component in a rotational direction about the longitudinal axis of the shaft and the charging of the second spring element moves the lift-off protection component in an axial direction defined along the longitudinal axis of the shaft.

11. The sliding door installation according to claim 10, wherein the at least one sliding door is supported to be displaceable in the roller running path by at least two roller carriages.

12. A method for protecting a sliding door of a sliding door installation having the features of claim 10, the method comprising the following steps:

displaceable affixing of the roller carriage at the roller running path, moving the lift-off protection component of the lift-off protection device out of the release position into a protection position, arresting the lift-off protection means in the protection position by component in the protection position with the arresting device.

* * * * *